United States Patent [19]

Wargin et al.

[11] 4,088,830

[45] May 9, 1978

[54] ELECTRICAL CABLE WITH INSULATED AND BRAID COVERED CONDUCTORS AND PERFORATED POLYOLEFIN ARMOR

[75] Inventors: Robert V. Wargin, Darien, Ill.; Clinton A. Boyd, Tulsa, Okla.

[73] Assignee: Borg-Warner Corporation, Chicago, Ill.

[21] Appl. No.: 717,436

[22] Filed: Aug. 24, 1976

[51] Int. Cl.[2] ..... H01B 3/28; H01B 9/06

[52] U.S. Cl. ..... 174/113 R; 174/102 SP; 174/110 AR; 174/120 AR

[58] Field of Search ..... 174/108, 109, 102 R, 174/102 SP, 102 D, 110 AR, 110 PM, 113 R, 113 AS, 120 AR, 120 SR, 120 R, 121 SR, 121 AR

[56] References Cited

U.S. PATENT DOCUMENTS

| | | | |
|---|---|---|---|
| 2,727,087 | 12/1955 | Hull | 174/109 |
| 3,621,118 | 11/1971 | Bunish et al. | 174/121 SR X |
| 3,634,607 | 1/1972 | Coleman | 174/108 X |
| 3,710,007 | 1/1973 | Hoeg et al. | 174/110 AR X |
| 3,710,009 | 1/1973 | Hoeg et al. | 174/110 AR X |
| 3,742,363 | 6/1973 | Carle | 174/102 D X |
| 3,832,481 | 8/1974 | Boyd et al. | 174/110 AR X |
| 3,889,049 | 6/1975 | Legg et al. | 174/108 X |

OTHER PUBLICATIONS

Luh, D. R., *Ethylene Propylene Terpolymers in Wire and Cable Construction,* Wire & Wire Products, Apr.-70, pp. 79-81.

*Primary Examiner*—Arthur T. Grimley
*Attorney, Agent, or Firm*—Richard J. Schlott

[57] ABSTRACT

Electrical cables having conductors, each provided with an insulation layer comprising a thermosetting elastomeric composition capable of imbibing low molecular weight well fluids when under pressure and rapidly desorbing the fluids when pressure is relieved which is surrounded by a confining braid layer, the insulated and braid-covered conductors being surrounded by a perforated outer armor formed of high temperature polyolefin, are able to withstand the environment within corrosive, gassy oil wells without corrosion of the armor and without undergoing depressurization-caused rupture failures.

4 Claims, 2 Drawing Figures

Fig. 1.
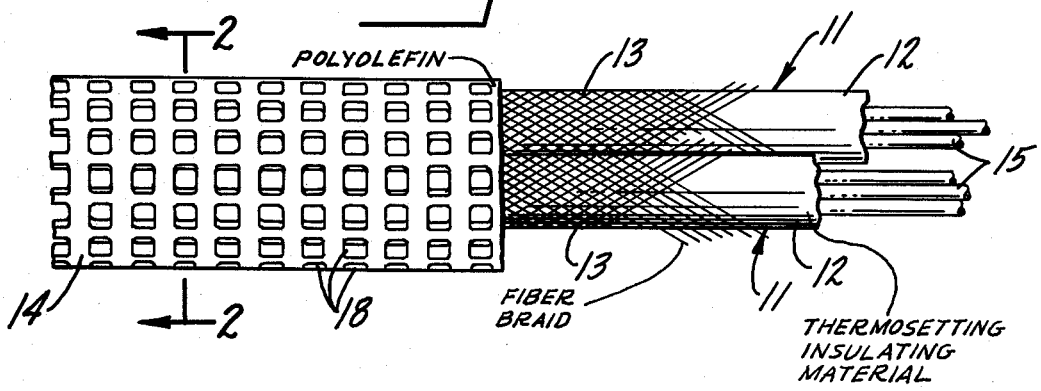
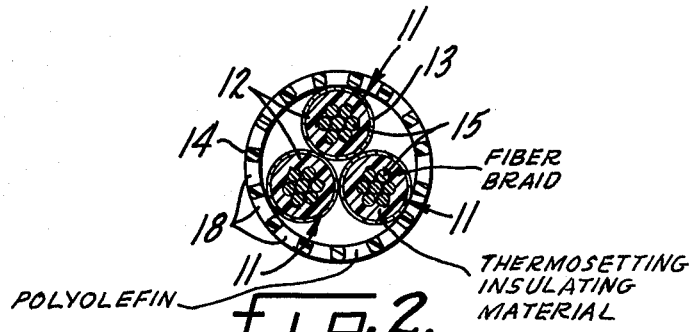
Fig. 2.

ELECTRICAL CABLE WITH INSULATED AND BRAID COVERED CONDUCTORS AND PERFORATED POLYOLEFIN ARMOR

Related U.S. application Ser. No. 717,437 filed Aug. 24, 1976, contains related subject matter.

BACKGROUND OF THE INVENTION

This invention relates to electrical cables. More particularly it relates to an electrical cable for use in gassy oil wells having particularly corrosive well fluids present therein which is adapted to depressurization-caused rupture failures from occurring in service and during removal from the well bore.

Prior art cable structures employed for oil well service include those having conductors of stranded copper, separately insulated with a material of high dielectric strength. To protect the insulated conductors from attack by well fluids, they are sheathed in an extruded elastomeric jacket adapted to resist penetration by the well fluids. Typical of these prior art cables is the structure disclosed in U.S. Pat. No. 3,485,939, having three conductors of stranded copper separately insulated and helically wound and sheathed in an extruded jacket of nitrile rubber or a similar elastomer. The rubber jacket is surrounded by an outer armor formed of a continuous wrapped band of a metallic material. The outer armor does not provide an hermetic seal, and exclusion of well fluids from the internal structure is intended to be accomplished by means of the water-resistant and hydrocarbon - impervious jacketing material. Invasion of these cable structures by low molecular weight well fluids occurs particularly when the cables are employed in highly gassy wells, either through gas permeation or by way of pinholes and other defects in the jacket. Although the jacketing and insulation layers of these prior art cables have been designed to resist chemical attack and deterioration when permeated by well fluids, the presence of low molecular weight hydrocarbons and gases under high pressure within the interstices of the cable structure frequently causes mechanical destruction such as blow outs and rupture failures. These ruptures are particularly likely to occur when the external pressure on the cable is decreased, as for example when the cable is removed from the well bore, inasmuch as these cables are not designed to withstand an unbalanced high internal pressure condition. The high internal pressures induce ballooning of the insulation and the jacketing material which then burst and rupture the metal armor, rendering the cable useless. Further, the metallic armor is subject to rapid corrosion when employed in wells having particularly acidic and corrosive well fluids present.

An improved prior art cable design, disclosed in U.S. Pat. No. 3,710,009, includes an extruded outer armor formed of a water-inpervious, high temperature heat-resistant polyolefin. The extruded armor provides a further mechanical barrier to invasion by well fluids, and unlike metal armors, is resistant to attack by acidic and corrosive well fluids. In practice it has been found that the interstices of these cable structures can also be penetrated by the low molecular weight hydrocarbons in highly gassy wells either by way of gas permeation or through defects and these cable structures similarly suffer from blow-out and rupture of the insulation, jacketing and armor, particularly during rapid depressurizing.

In a third prior art cable construction, disclosed in U.S. Pat. No. 3,835,929, the jacketed well cable is encased in a continuous metallic tube, sealed at the lower end and extending to the surface. Such constructions are difficult to employ in the field, and require cables having tensile strength sufficient to withstand installation in an unsupported manner through the entire length of the tubing. Additionally, intrusion of low molecular weight well fluids such as methane under high pressure through a defective seal means at the lower end would result in a fluid-filled conduit which turn would make subsequent removal of the cable both difficult and hazardous.

Other methods for protecting well cables from damage by highly pressurized low molecular weight well fluids have also generally relied on a combination of materials to enhance the cable's mechanical resistance to penetration. It has not heretofore been possible to completely prevent gas permeation of these cables when under very high pressure, and a cable structure for use in gassy wells capable of withstanding permeation by low molecular weight well fluids and attack by corrosive well fluids without consequent ruptures and blow out failures would clearly be a welcome advance in the art.

SUMMARY OF THE INVENTION

The present invention relates to an improved electrical cable structure for use with submersible motors, capable of withstanding attack by corrosive well fluids and permeation by low molecular weight well fluids under pressure without subsequent ruptures and blow out failures being caused by rapid depressurization. More particularly, the present invention relates to an electrical cable employing conductors separately insulated with a layer of a polymeric material adapted to resist attack by well fluids and surrounded by a confining braid layer, and an outer armor of polyolefin adapted to permit rapid escape of well fluids from within the cable structure, said cable being particularly useful in gassy oil wells having a particularly acidic and corrosive environment.

The conductor insulation disclosed for use in gassy oil wells is a thermosetting elastomeric polymer which is an excellent electrical insulator at elevated temperatures and virtually impervious to attack by oil and other well fluids. The conductor insulation may be regarded as somewhat porous in that it is capable of imbibing very low molecular weight hydrocarbons found in gassy oil wells, e.g. methane, ethane and the like, when under high pressure and then rapidly desorbing the imbibed gassy hydrocarbons when external pressure is removed. One such material useful for these purposes is a modified EPDM (ethylene-propylene-diene monomer terpolymer) blend such as is disclosed in U.S. Pat. No. 3,926,900.

The insulated conductors are each surrounded and confined by a layer of braid. Materials commonly employed in the cable art for this purpose include a variety of nylon filament braids, and a material particularly useful for this purpose is a nylon 66, braided and lacquered with a nylon lacquer.

Insulated and braid-wrapped conductors of this invention are suitable for service when immersed in and surrounded by the well fluids under high temperatures and pressures, and are not susceptable to depressurization failure. The conductor insulation is particularly insensitive to well fluids, and protects and insulates the conductor. The braid layer tightly surrounds the insulation. Where minor amounts of low molecular weight well fluid permeate the insulation layer and perhaps invade the conductor area, the braid layer restrains the insulation layer against swell and rupture from high internal pressure, and the low molecular weight fluids are desorbed without rupture or damage to the insulation.

When formed into electrical cables, the insulated conductors of this invention are not enclosed within an elastomeric jacketing, but rather are disposed within a polyolefin outer armor adapted to permit free flow of the well fluids into and out of the cable structure. The outer armor provides mechanical protection against abrasion and damage in use and resists attack by particularly corrosive well fluids. Ingress and egress of well fluids to and from the internal portion of the cable structure occurs by way of the armor, and the fluids will thus freely escape during a rapid depressurizing.

In prior art cable constructions such as those disclosed in U.S. Pat. No. 3,710,009, the insulated conductors are surrounded first by an elastomeric jacketing, then by a polyolefin outer armor. The elastomeric jacketing is provided to afford a mechanical barrier to penetration by well fluids, thereby preventing attack and consequent weakening of the primary insulation layer. The plastic outer armor is resistant to corrosion and is provided both to protect the cable from abrasion and to afford a further mechanical barrier to penetration by well fluids, particularly water, and consequent weakening of the jacketing. When used in particularly gassy wells, gas permeation of the cable structure occurs by way of absorption or defects. The low molecular weight fluids then present within the structure under high pressure are confined by the jacketing during a subsequent depressurization. Escape of the fluid cannot occur rapidly, and the jacketing consequently balloons to cause rupture of the jacket and the armor. In these prior art cables, the jacketing could not be omitted since the conductor insulation would then be subject to penetration by low molecular weight well fluids, ballooning and rupture failure upon depressurizing and consequent dielectric failure and burn-outs.

In the cable construction of the present invention the need for jacketing is obviated by the use of a relatively thin insulation layer capable of imbibing and desorbing low molecular weight well fluids, surrounded and confined by a braid layer. Where minor amounts of low molecular weight well fluids succeed in permeating the thin insulating layer and penetrating into the area between the conductor strands, the confining braid layer has sufficient mechanical strength to restrain swell, thus preventing ballooning and blow-out failure and requiring the low molecular weight well fluids to escape from the insulation layer by desorption. Without jacketing, the well fluids can freely escape through the perforated outer armor during depressurization. A high and unbalanced internal pressure condition is thereby avoided and costly blow-outs rupture failures and corrosive destruction of the cable will not occur. Unlike metal armors, the polyolefin armor resists attack by acidic and corrosive well fluids.

Further advantages of the present structure will become apparent with reference to the following description and accompanying drawings.

DESCRIPTION OF THE DRAWINGS

FIG. 1 is a view of a section of electrical cable for submersible motors illustrating various features of the invention.

FIG. 2 is a cross-sectional view of the cable taken generally along lines 2—2 of FIG. 1.

DESCRIPTION OF THE ILLUSTRATED EMBODIMENTS

Referring now to the drawings, there is shown a multicomponent insulated electrical cable designed for use in highly corrosive gassy oil wells which is illustrative of the principles of the present invention.

FIG. 1 shows a cable section which includes conductors 11, insulation 12 braid layer 13, and outer armor 14.

Each conductor 11 is formed of stranded wire 15 helically wound and blocked to prevent separation of strands. These separate strands may be tinned to minimize chemical interaction between the conductor and the insulating material.

In the illustrated embodiment each conductor includes seven strands. The number of conductors, the diameter of the conductor and the number of wires is, of course, dependent upon the electrical load carrying capabilities required for a particular cable application. It should additionally be noted that any suitable conducting material may be used, such as for example, copper, aluminum, etc.

The wound set of wire strands forms a single conductor and is insulated by an insulation layer 12. The conductor insulation 12 is formed of a high temperature, oil-and brine resistant polymer insulation material.

Insulation materials useful for the purposes of this invention are thermosetting elastomeric compositions which will not be subject to chemical attack by well fluids, and which will resist being swelled or softened by hydrocarbons. The insulation materials must not provide a complete barrier to gas permeation or penetration at the molecular level by very low molecular weight hydrocarbon fluids, including methane under high pressure and they may even be highly permeable to hydrocarbon gases, however the physical and electrical properties of the insulation layer must remain essentially unaffected thereby.

One insulation material found to be satisfactory for this purpose is a modified EPDM blend as disclosed in U.S. Pat. No. 3,926,900. A blend represented by the following formulation may be employed as the insulation material in the practice of this invention:

| Material | Parts by Weight | Source |
|---|---|---|
| EPDM with Napthenic Oil, 2:1 | 105 | B. F. Goodrich Co., |
| Liquid Polybutadiene | 30 | Lithcoa |
| Zinc Oxide | 5 | |
| Stearic Acid | 1 | |
| Dihydroquinoline | 1 | |
| Titanium Dioxide | 10 | |
| Clay | 100 | |
| Trimethylolpropane Trimethacrylate | 2 | Ware Chemical Co. |
| Peroxide | 11 | Hercules Chemical Co. Dicup 40KE |

This insulation material will be extruded unto the conductor and cured in place to provide an insulation layer resistant to attack by water and well fluids. A characteristic property of this insulation material is that it will imbibe gassy low molecular weight hydrocarbons under pressure and rapidly desorb the imbibed hydrocarbons when the external pressure is removed. Depending upon the conductor material employed, further stabilization to heat and metals may be required and the use of stabilizers for this purpose is widely known in the insulation art. The thickness of the insulation layer may be varied according to the electrical insulation requirements of the cable and the size of the particular conductors employed. Excessive thickness is to be avoided, however, inasmuch as the rate of desorption of minor amounts of low molecular weight well fluids from within the insulation layer will be dependent upon the thickness of the insulating material, and the preferred thickness will be in the range of 0.020 to 0.150 in., more preferably between 0.070 and 0.100 in. To provide added electrical insulation for use in extreme temperature conditions, a thin layer of a high temperature fluorocarbon polymer may be included either as a first or second layer in the manner set forth in U.S. Pat. No. 3,832,481, or more preferably in the form of overlapping wrap of fluorocarbon polymer tape.

The insulated conductor is then tightly covered with a braid layer 13. While a number of synthetic and natural fibers have been employed in the art as braid for insulation purposes, fiber materials suitable for the purposes of this invention will be resistant to attack by well fluids at elevated temperatures and including fibers of nylon, dacron, fluoropolymers, high temperature polyamides and the like. A preferred material is a conventional nylon 6—6 continuous filament yarn braid. Methods for applying braid to an insulated conductor are widely known. It is necessary that the braid be tightly formed to the insulation layer and have sufficient tensile properties to contain and restrain the insulation layer against ballooning and consequent rupture where high internal pressures obtain during use. Added strength may be afforded by a post-lacquering of the braid layer.

The insulated conductors are wound and disposed within the extruded outer armor 14 formed of a high temperature heat stabilized polyolefin. The polyolefin must have excellent heat resistance, especially with respect to high temperature creep characteristics. A particular high temperature high molecular weight heat stabilized polyolefin useful for the practice of this invention is a polypropylene commercially available under the trade name Avisun 1046 from Amoco Corporation. This material has been found to possess the following properties:

| |
|---|
| Molecular Weight - high as evidenced by a reduced viscosity of n sp/c = 3.5 dl/g, in decalin at 135° C. |
| Specific Gracity 0.90 – 0.91 at 23° C. (ASTM-D-792-64T) |
| Deflection Temperature 230° F. at 66 psi (ASTM-D-648-11) |
| Flexural Modulus 180,000 psi (ASTM-D-790-66) |

The outer armor is preferably formed by extrusion in a surrounding relationship to the wound conductors as the conductors progress through an appropriate extrusion die. Conventional cable jacketing is not employed in these cable structures. During the armoring operation, the wound conductors may optionally be formed into a unit by a wrap of filler cloth, paper tape or other porous material if desired. This practice is frequently employed in the cable art to hold the insulated conductors securely in proper relationship during the armoring operation and to protect the insulation layer from damage, however, for the purposes of the instant invention the practice is optional.

The particular polypropylene described has excellent abrasion resistance and forms a tough outer cable surface. Unlike most conventional metallic armors, it is resistant to attack or deterioration by chemical agents including the salts, acids, gases, water and hydrocarbons present within the well and exhibits little, if any, environmental stress cracking. Additionally, the polypropylene armor described retains its abrasion resistance at high and low temperatures and is sufficiently resilient to allow reeling and unreeling without cracking or stress failure. It may be protected from sunlight deterioration by conventional methods, including the formulating with darkening pigments and ultraviolet light stabilizers.

The polypropylene armor is adapted to permit free entry of well fluids by means of perforations 18. In the particular embodiment shown in FIG. 1, the perforations are located in the armor at regular intervals linearly along the surface. However, it will be understood that the particular placement of the perforations will be a matter of choice, and satisfactory cable armor may be formed with perforations randomly placed or in geometric patterns if desired. The perforations may be small and great in number or large in size and very much fewer in number so long as the cable armor retains sufficient tensile strength. As a practical matter, the size and frequency of the perforations will be sufficient to permit complete draining of well fluids from the cable during the operation of removing it from a well bore, inasmuch as the handling of a cable partially or completely filled with well fluids would be both difficult and potentially dangerous. The preferred number and size of the perforations will thus be determined in part by considering the internal free volume of the particular cable being constructed, and will be kept at a minimum to avoid detrimental loss in tensile properties and consequent weakening of the cable structure.

The perforated armor is readily formed by an extrusion process wherein the perforations are created in the armor by a rotating die at the time the armor is extruded over the cabled conductors. Alternatively the armor may be extruded without perforations and the perforations formed therein during a subsequent processing step such as punching, hot needle perforating, or the like. Further methods of forming a suitable perforated armor include surrounding the cabled conductors with a woven structure formed from a suitable polyolefin strip or filament, and, optionally, heat-sealing the resulting woven filament or strip armor to provide added rigity thereto.

An example of a well cable illustrating features of the present invention has been constructed. It includes 3 seven-wire, stranded copper conductors, each of which is surrounded by an insulated layer having an average thickness of 0.100 inches formed of a modified EPDM blend as given hereinabove, and each in turn being tightly surrounded by a braid layer of nylon monofilament.

The particular nylon braid is formed of 200/10 denier nylon 66, with 3 ends, dry woven 2 over and 2 under, to give a braid having 18.75 picks per inch. The braid is post-lacquered with three dips of an alcohol-water solution of nylon, each air-dried.

The separate conductors are wound and wrapped as a unit with filler cloth and provided with an outer armor formed by extruding the high temperature, high molecular weight polypropylene composition disclosed hereinabove. The armor was then perforated by hand to have one-eighth inch perforations linearly spaced at a frequency of about 100 per lineal foot of cable.

As can be appreciated, when in service within an oil well, the well fluids under high pressure freely invade the cable structure by way of the perforated armor, but are prevented from contact with the conductors by the oil-and-water resistant insulation layer. Minor amounts of the low molecular weight hydrocarbon fluids such as methane present in the well under high pressure may penetrate the insulation layer by way of chemical and/or physical absorption processes, but the effect on the insulation layer will be minimal. Upon rapid depressurizing, as for example, during removal of the cable from the well, the bulk of the well fluid is free to escape from the internal cable structure by way of the perforations in the polyolefin armor. Minor amounts of hydrocarbon fluid present in the insulation layer and possibly within the stranded conductors are prevented from rupturing or blowing-out the insulation layer by the tightly-confining braid layer and so are constrained to escape by a de-sorption process.

It will be understood that this blowing-out or rupture was not preventable by prior art cable constructions such as those found in U.S. Pat. No. 3,710,009 inasmuch as the relatively thick, gas-impervious, non-porous jacketing material and the non-perforated polyolefin armor retained the pressurized fluids that penetrated into and through the jacketing. Upon depressurizing, the jacket and the armor were then ballooned from within by the high pressure fluids and both the jacketing and the armor were ruptured.

The instant invention will thus be seen to be an electrical cable suitable for use in the environments within corrosive gassy oil wells comprising a plurality of conductors each having a relatively thin insulation layer formed of a thermosetting polymeric material resistant to attack by well fluids but capable of imbibing and desorbing low molecular weight hydrocarbons surrounded by a braid layer adapted to confine the insulation layer and restrain against swell and blow-out from an unbalanced internal pressure condition, and a perforated outer armor surrounding the conductors formed of a high temperature heat stabilized polyolefin.

Various features of the invention have been particularly shown and described in connection with the illustration embodiments of the invention. However, it must be understood that these particular arrangements are for illustrative purposes and that the invention is to be given its fullest interpretation within the scope of the appended claims.

We claim:

1. An electrical cable having a plurality of conductors, each of said conductors being surrounded by a layer of oil- and brine-resistant thermosetting insulating material, said layer of insulating material being surrounded and confined by a braid layer and an outer armor surrounding said conductors formed of a high temperature, high molecular weight polyolefin adapted to permit free flow of well fluids into the cable structure.

2. The electrical cable of claim 1 wherein said insulating material is cured EPDM ethylene-propylene-diene monomer terpolymer composition comprising EPDM ethylene-propylene-diene monomer terpolymer, hydrocarbon oil and polybutadiene.

3. The electrical cable of claim 1 wherein the braid layer is formed from a fiber selected from nylon fiber, polyethylene terephthalate fiber, polyamide fiber, glass fiber and fluorocarbon polymer fiber.

4. The electrical cable of claim 1 wherein the outer armor is perforated.

* * * * *